US008329091B2

(12) United States Patent
Maffia

(10) Patent No.: US 8,329,091 B2
(45) Date of Patent: Dec. 11, 2012

(54) POROUS METALLIC STRUCTURES

(75) Inventor: Gennaro J. Maffia, Newtown Square, PA (US)

(73) Assignee: Widener University, Chester, PA (US)

( * ) Notice: Subject to any disclaimer, the term of this patent is extended or adjusted under 35 U.S.C. 154(b) by 87 days.

(21) Appl. No.: 12/696,294

(22) Filed: Jan. 29, 2010

(65) Prior Publication Data

US 2010/0221136 A1 Sep. 2, 2010

Related U.S. Application Data

(60) Provisional application No. 61/148,616, filed on Jan. 30, 2009.

(51) Int. Cl.
*B22F 3/11* (2006.01)
*B32B 15/02* (2006.01)

(52) U.S. Cl. ..... 419/2; 419/4; 419/6; 75/228; 75/230; 75/330

(58) Field of Classification Search ..... 419/2, 6, 419/4; 75/230, 330, 228
See application file for complete search history.

(56) References Cited

U.S. PATENT DOCUMENTS 3,232,754 A * 2/1966 Storchheim ..... 419/2
4,140,537 A * 2/1979 Luck et al. ..... 106/160.1
4,251,603 A 2/1981 Matsumoto et al.
4,775,598 A 10/1988 Jaeckel
4,861,714 A * 8/1989 Dean et al. ..... 435/69.1
4,863,856 A * 9/1989 Dean et al. ..... 435/69.1
4,957,543 A 9/1990 Babjak et al.
5,296,261 A 3/1994 Bouet et al.
5,629,191 A * 5/1997 Cahn ..... 435/395
5,640,669 A 6/1997 Harada et al.
5,759,400 A 6/1998 Fanning
5,881,353 A 3/1999 Kamigata et al.
6,660,829 B1 * 12/2003 Maffia ..... 530/356
2004/0028738 A1 * 2/2004 Huang et al. ..... 424/484
2010/0016989 A1 * 1/2010 Lyngstadaas et al. ..... 623/23.72

FOREIGN PATENT DOCUMENTS

JP 06-217596 8/1994

OTHER PUBLICATIONS

Rho et al.—"Electrospinning of collagen nanofibers", Biomaterials, 27, 2006, p. 1452-1461.*
Brown et al., "The effect of ultrasound on bovine hide collagen structure", JALCA, (no month available) 2006, 101(7), 274-283.
Lastowka et al., "A Comparison of Chemical, Physical and Enzymatic Cross-Linking of Bovine Type I Collagen Fibrils", JACLA, (no month available) 2005, 100(5), 196-202.

* cited by examiner

*Primary Examiner* — Devang R Patel
(74) *Attorney, Agent, or Firm* — Woodcock Washburn, LLP

(57) ABSTRACT

In one aspect, there are provided methods for producing porous metallic structures, wherein the methods involve the use of collagen fibrils on the nanometer scale as a "sacrificial" scaffold upon which metal particles are deposited. Also disclosed are structures comprising a porous metallic matrix having favorable strength, porosity, and density characteristics. Structures produced in accordance with the present disclosure are useful for, inter alia, the fabrication of devices such as filters, heat exchangers, sound absorbers, electrochemical cathodes, fuel cells, catalyst supports, fluid treatment units, lightweight structures and biomaterials.

25 Claims, 6 Drawing Sheets

A

B

POROUS METALLIC STRUCTURES

CROSS-REFERENCE TO RELATED APPLICATION

The present application claims priority to U.S. Provisional App. No. 61/148,616, filed Jan. 30, 2009, which is hereby incorporated by reference in its entirety.

TECHNICAL FIELD

The technical field relates generally to highly porous structures formed from mixtures comprising metallic materials.

BACKGROUND

Collagen is an abundant structural protein that is present in all animals. Collagen is insoluble in water, but when properly prepared, can hold and retain many times its own mass in water due to its naturally charged surface characteristics. In fact, the surface charge of collagen is a key physical property that allows the protein to be adapted for a wide variety of practical uses including environmental remediation, purification of biological samples, and other engineering and biotechnological applications.

Dispersions of collagen have been formed using a starting material of raw fibrillar type I bovine corium. See U.S. Pat. No. 6,660,829. It was found that collagen dispersions can be frozen and then freeze dried, resulting in a product that retains the overall dimensions of the original frozen material. At the same time, over 99% of the volume of the lyophilized product is porous "empty" space and the remaining protein component has a spongy organic aerogel-type structure with controllable pore size, good mechanical properties, and a density as low as one thousandth of water. It was further found that this solid material can be crosslinked to anchor or memorize its shape, pore size and morphology. Id.

It was also disclosed that such dispersions can be used in environmental applications, and may function as an aid to filtration, to assist in the separation of pollutants (including metals and soluble organic molecules) from aqueous streams, for selective fractionation of molecules, and in oil droplet stabilization. Variations on the production process for dispersions of this type could provide additional end products and useful results not heretofore observed.

Porous metal or ceramic materials are useful for the fabrication of devices such as filters, heat exchangers, sound absorbers, electrochemical cathodes, fuel cells, catalyst supports, stand-alone catalysts, fluid treatment units, lightweight structures and biomaterials. The end use of the porous material may be determinative of the requirements for structure (such as open/closed porosity, pore size distribution and shape, density) and physical properties (such as permeability, thermal, electrochemical and mechanical properties). For example, closed porosity is usually sought for lightweight structures, while open porosity may be desired when one or more of surface exchange, permeability, and pore connectivity is required.

Numerous different approaches exist for the fabrication of such porous materials. Deposition techniques have been used for the fabrication of metal foam. U.S. Pat. No. 4,251,603 and Japanese Patent Application No. 5-6763 describe processes that involve plating a sponge-like resin followed by burning the resin to obtain a metal foam. Deposition may also be performed from salts (U.S. Pat. No. 5,296,261) or gas (U.S. Pat. No. 4,957,543). Those processes provide low-density materials having open-cell porosity.

Techniques involving the deposition of powders on polymer medium (foams or granules) have also been developed. Those techniques consist in deposing metal or ceramic particles on a polymer and burning the polymer to obtain porous metal or ceramic materials. U.S. Pat. No. 5,640,669 describes a process for preparing a metal porous body having a three-dimensional network structure by deposing a layer comprising Cu, a Cu alloy, or a precursor thereof on a skeleton composed of a porous resin body having a three-dimensional network, followed by heat-treating the resin body with the layer formed thereon to remove the heat-decomposable organic component, thereby forming a porous metal skeleton of Cu or a Cu alloy.

U.S. Pat. No. 5,759,400 describes the fabrication of metal foams by cutting a polyethylene foam to form a substrate having a desired size and shape, submerging the polyethylene substrate into a solvent for a period of time effective to provide a substrate with a tacky surface, coating the tacky surface of the polyethylene with a slurry of copper powders admixed with a binder, drying the impregnated polyethylene foam, burning the polyethylene in a furnace to produce a foam structure consisting of copper and sintering the final product to obtain a rigid structure.

U.S. Pat. No. 5,881,353 discloses a method for producing a porous body with high porosity by coating a resin foam, such as urethane foam, with an adhesive to impart stickiness to the surface of the foam, and thereafter a powder such as copper oxide powder is applied thereto, followed by heating to remove the substrate and sinter the powder. Thus, a porous body to which the pattern of the base material has been transferred is produced. The powder may be appropriately selected to obtain porous bodies having a great strength, without limitations on materials.

Methods for preparing porous hollow spheres and sponge like particles are described in U.S. Pat. No. 4,775,598. Such porous hollow spheres could be used to produce porous materials. The process for making hollow spherical particles comprises the steps of providing metallized lightweight spherical bodies from cores of a foamed polymer with a metal coating of a thickness of 5 to 20 microns; coating said metallized lightweight spherical bodies with a dispersion of at least one particulate material selected from the group which consists of metals, metal oxides, ceramics and refractories to a dispersion coating thickness of 15 to 500 microns; drying the dispersion coating on said metallized lightweight spherical bodies to form a dry layer of said material thereon; heating said metallized lightweight spherical bodies with said dry layer of said material thereon to a temperature of about 400° C. to decompose said polymer cores and form hollow bodies essentially consisting of said metal coatings and said dry layers of said material thereon; and subjecting said hollow bodies essentially consisting of said metal coatings and said dry layers of said material thereon to a sintering temperature of 900° C. to 1400° C. for a period sufficient to sinter the material of the respective layer and the respective layer to the respective metallic coating, thereby forming hollow spherical particles.

In view of the numerous end uses for porous metal or ceramic materials, there remains a need for structures that are characterized by high porosity, strength, durability, and uniform pore distribution, and that can be made by methods that allow for the adjustment of pore size, porosity, or other characteristics of the final product, depending on the desired end use.

SUMMARY

In one aspect, there are provided methods for producing a porous metallic structure comprising blending a metal powder with a dispersion of collagen nanofibrils in a carrier; forming a shaped body from the blend; optionally heating the shaped body at a temperature above the eutectic point of the blend and cooling the shaped body to a temperature below the eutectic point of the blend; reducing the amount of solvent in the shaped body; and, removing a major proportion of the collagen nanofibrils from the shaped body. Also provided are porous metallic structures that are produced in accordance with the described methods.

In another aspect, disclosed are structures comprising a porous metallic matrix having a strength rating of about 100 to about 1000 grams, an average pore size of about 5 to about 100 microns, a density of about 1 g/mL to about 7 g/mL, and an average porosity of at least about 90%.

DETAILED DESCRIPTION OF ILLUSTRATIVE EMBODIMENTS

Figure 1:
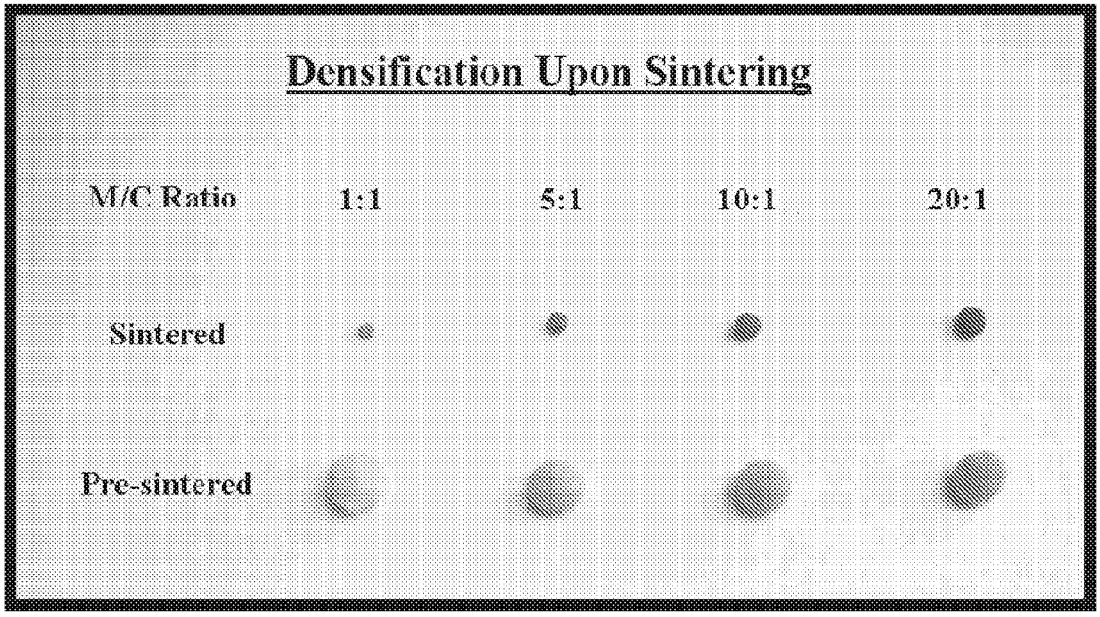
FIG. 1 provides a depiction of how metal to collagen ratio influences densification during the process of producing the instant porous metallic structures.

The present invention may be understood more readily by reference to the following detailed description taken in connection with the accompanying figures and examples, which form a part of this disclosure. It is to be understood that this invention is not limited to the specific products, methods, conditions or parameters described and/or shown herein, and that the terminology used herein is for the purpose of describing particular embodiments by way of example only and is not intended to be limiting of the claimed invention.

The disclosures of each patent, patent application, and publication cited or described in this document are hereby incorporated herein by reference, in their entirety.

As employed above and throughout the disclosure, the following terms and abbreviations, unless otherwise indicated, shall be understood to have the following meanings. In the present disclosure the singular forms "a," "an," and "the" include the plural reference, and reference to a particular numerical value includes at least that particular value, unless the context clearly indicates otherwise. Thus, for example, a reference to "a metal" is a reference to one or more of such metals and equivalents thereof known to those skilled in the art, and so forth. When values are expressed as approximations, by use of the antecedent "about," it will be understood that the particular value forms another embodiment. As used herein, "about X" (where X is a numerical value) preferably refers to ±10% of the recited value, inclusive. For example, the phrase "about 8" preferably refers to a value of 7.2 to 8.8, inclusive; as another example, the phrase "about 8%" preferably refers to a value of 7.2% to 8.8%, inclusive. Where present, all ranges are inclusive, divisible, and combinable. For example, when a range of "1 to 5" is recited, the recited range should be construed as including ranges "1 to 4", "1 to 3", "1 to 2", "1 to 2 and 4 to 5", "1 to 3 and 5", and the like. In addition, when a list of alternatives is positively provided, such listing can be interpreted to mean that any of the alternatives may be excluded, e.g., by a negative limitation in the claims. For example, when a range of "1 to 5" is recited, the recited range may be construed as including situations whereby any of 1, 2, 3, 4, or 5 are negatively excluded; thus, a recitation of "1 to 5" may be construed as "1 and 3-5, but not 2", or simply "wherein 2 is not included." It is intended that any component, element, attribute, or step that is positively recited herein may be explicitly excluded in the claims, whether such components, elements, attributes, or steps are listed as alternatives or whether they are recited in isolation.

Unless otherwise specified, any component, element, attribute, or step that is disclosed with respect to one embodiment of the present methods or products may apply to any other method or product that is disclosed herein.

In one aspect, the present disclosure provides methods for forming porous metallic structures using collagen matrices as scaffolds during the production process. The instant methods comprise blending a metal powder with a dispersion of collagen nanofibrils in a carrier; forming a shaped body from the blend; optionally heating the shaped body at a temperature above the eutectic point of the blend, followed by cooling the shaped body to a temperature below the eutectic point of the blend; reducing the amount of solvent in the shaped body; and, removing a major proportion of the collagen nanofibrils from the shaped body.

Collagen is used in the present methods as a "sacrificial scaffold" upon which metal particles are deposited in order to form a porous metallic structure. The collagen comprises nanofibrils and the scaffold may comprise interwoven collagen nanofibrils. Structurally distinct collagen fibrils on the nanometer scale are not naturally occurring, and must be produced from the raw collagen bundles (about 5 microns in diameter) that are found within most living creatures. Sources of raw collagen include corium, which comprises large, type-I collagen bundles and is a common by-product of the rendering industry. Thus, the production of the collagen nanofibrils may include providing a solution of raw corium, the corium comprising a plurality of bundled collagen fibers. The production and use of collagen nanofibrils for forming collagen dispersions as sacrificial scaffolds is made possible by the discovery by the present inventors that the formation of nanofibrils occurs when collagen fibrils are processed in sufficiently large volume; previous techniques, such as those disclosed in U.S. Pat. No. 6,660,829, did not involve a "scaled-up" process whereby the production of nanofibrils was obtained. As disclosed infra, the total volume of starting collagen material will determine whether nanofibrils are actually formed in acceptably high yields. Furthermore, the inventive process allows for the formation of nanofibrils having a high degree of uniformity, i.e., an average diameter with a low standard deviation; for example, in some embodiments, a given sample of collagen fibrils produced in accordance with the present disclosure may have a yield of nano-scale structures that exceeds 95%, exceeds 97%, exceeds 99%, exceeds 99.5%, or that is about 100%. Prior techniques yielded results in which a given sample of collagen fibrils possessed a relatively wide range of diameters on the micrometer scale.

The source of the collagen, and where used, the raw corium, may be any living creature that naturally contains collagen fibers, or may be from any artificial source or sources (e.g., as produced by genetically engineered bacteria). The collagen may be from a single source (that is, a single species) or from multiple sources. Nonlimiting examples include collagen of bovine, equine, or porcine origin, or any mixture thereof. Bovine collagen has been used in the production of the instant porous metallic structures with excellent results. The present inventors have surprisingly discovered that porcine collagen, although possessing certain characteristics that distinguish it from bovine collagen, may also be used in the production of the instant metallic porous structures. It has been observed that porcine collagen behaves somewhat differently during the dispersion process (described infra); without intending to be bound by any particular theory of operation, the porcine collagen material appears to have a more lengthy induction period prior to thickening than bovine collagen. The resulting dispersion is of very good quality, but takes additional time and mechanical intervention (e.g., more blending) to thicken.

Regardless of its source, the solution of raw corium may be milled in order to induce separation of the individual collagen fibrils. Any milling process may be used. In a preferred embodiment, milling is performed in a conventional ball mill. During milling, the pH of the solution of raw corium is near neutral; the isoelectric point occurring at a pH of about 6.5. The recovered nanofibrils are dispersed in an organic acid solution preferably with a pH between about 2 and about 6, between about 2.5 and about 5, or between about 3 and about 4.5.

It has been discovered that sonication (the application of ultrasound) of the solution of raw corium prior to or even during milling can yield improved results, i.e., smaller-diameter collagen nanofibrils, as compared with when such sonication steps are omitted. A subset of nanofibrils that have been given the misnomer of "microfibrils" (misnamed because such fibrils are respectively said to have smaller diameters than those of nanofibrils) is observed when sonication is performed to the processing. Prior to the discovery by Brown, E M et al. *The Effect of Ultrasound on Collagen Structure, JALCA Vol.* 101, 274-279 (2006), there had been considerable debate as to the existence of a microfibril. The solution of raw corium may therefore be subjected to sonication prior to or during milling. Sonication may be performed in accordance with any of the conditions described in Brown, E M et al., supra.

The volume of the solution of raw corium that is introduced into the milling apparatus should be sufficiently large to enable the production of nano-scale collagen fibrils. For example, the volume of the solution of raw corium should be at least 1 kg per 2 L of DI water and 2 L of milling stones when used in an approximately 10 L milling vessel. The quantity of solution of raw corium may be adjusted depending on traditional scaling calculations for ball mills. The milling time may be between about 7 and about 14 days. The milling time may be shortened by altering any of a number of conditions, such as by decreasing total solution volume, raising the temperature of the milling environment (e.g., up to, but no higher than, 37° C.), or adjusting mill speed. However, the milling time of between about 7 and about 14 days under adiabatic conditions (i.e., without deliberate heating or cooling) has been found to be excellent for producing a high yield of nanofibrils. Preferably, the milling vessel is equipped with a pressure release valve to accommodate the extended milling period; for example the milling vessel may include a 5 psig safety valve. Although not intending to be bound by a particular theory of operation, the principle that underlies the fibril separation process is believed to be that a surface charge is induced on each of the fibrils allowing them to retain water between them. This chemical potential, in tandem with the mechanical energy from the milling, causes the fibrils to repel each other and remain separated in solution. Milling may be accompanied by one or more filtration steps in order to remove unmilled granules of collagen.

Up to a point, as the milling time of the solution of raw corium increases, so does the level of fibril separation; beyond the complete separation to nanofibril dimension, additional milling can cause denaturation. The present inventors observed incremental results of the milling process. The resulting nanofibrils may individually have a diameter of about 10 nm to about 250 nm. The disclosed milling process may be used to yield a dispersion of collagen nanofibrils that are individually of substantially similar diameter. For example, the resulting dispersion may comprise nanofibrils having an average diameter with a standard deviation of about ±10 nm, about ±5 nm, about ±2 nm, or about ±1 nm.

The milled corium solution may be sonicated in order to induce further separation of the collagen nanofibrils. Sonication is generally preferable in instances where nanofibrils having an average diameter of about 30 nm or less are desired. Sonication may be performed in accordance with any of the conditions described in Brown, E M et al., supra.

Following milling and optional sonication, collagen nanofibrils are "recovered" by separating the insoluble collagen from fats and soluble materials that are present in the solution, having been left over from the starting material. The recovery of the collagen may comprise one or more of straining/filtration, washing, and centrifuging. Any or all of these steps may be repeated several times until no fats or other soluble materials visibly appear or appear by optical analysis in the upper aqueous phase. The centrifugation is preferably performed at low temperature, for example, from about 0° C. to about 10° C., or from about 0° C. to about 5° C., for about 0.5 to about 3 hours, preferably 1 hour, at a speed of about 2000 to about 5000 RPM, preferably about 3500 RPM.

The milled, optionally sonicated, and recovered collagen is preferably dispersed in a medium having a pH that is below the isoelectric point of collagen, which is about pH 6.5 to 7. The collagen may be dispersed in the medium by blending. The medium may comprise an acid, such as an organic acid. Thickening of the dispersed collagen occurs over time and may be allowed to occur over one or more hours, days, weeks, or months. As described previously, different collagen preparations may require different thickening times.

The recovered collagen nanofibrils are then blended into a carrier. The collagen nanofibrils may have an average diameter of about 5 nm to about 250 nm, about 10 nm to about 250 nm, about 10 nm to about 100 nm, about 10 nm to about 50 nm, about 10 nm to about 30 nm, about 15 nm to about 30 nm, or about 20 nm to about 30 nm. The carrier is an acidic aqueous solution, i.e., an aqueous solution having a pH lower than 7. In one embodiment, the carrier is a solution of water and an organic acid. The organic acid may be acetic acid. The present methods also include blending a metal powder in the carrier. The collagen may be blended into the carrier by itself, or may be blended into the carrier with a metal powder. For example, the collagen may be blended into the carrier by itself in order to form a blend comprising 94% by weight water, 5% by weight acetic acid, and 1% by weight collagen nanofibrils.

The ratio of metal powder to collagen in the blend is about 1:1 to about 300:1 by weight. For example, the ratio of metal powder to collagen may be about 1:1, about 2:1, about 5:1, about 10:1, about 20:1, about 25:1, about 30:1, about 40:1, about 50:1, about 100:1, about 150:1, about 200:1, about 250:1, or about 300:1 by weight. As will be appreciated among those skilled in the art, metal ratios may be dictated by the ultimate application.

The metal powder may comprise any metal that would be stable for up to about 2 hours, preferably about 1 hour, in an acidic dispersion. Preferably, the metal powder comprises any metal or metals that do not readily undergo chemical reaction, or react slowly, with the components of the collagen dispersion, which may include aqueous acetic acid. For example, the metal powder may comprise one or more of aluminum, copper, stainless steel, titanium, zinc, iron, chromium, and tin. Manganese or similar active transition metals may also be used if the contents of the dispersion are selected to avoid a violent reaction therewith (which can occur if acid were present). The metal powder may comprise a single metal species, or may comprise at least two different metal species. When the metal powder comprises at least two different metal species, the ratio of the first metal species to a second metal species in the metal powder may be about 1:1 to about 1:20 by weight. For example, the metal powder may comprise a first metal powder and a second metal powder in a ratio of about 1:1, about 1:2, about 1:5, about 1:9, about 1:10, about 1:15, or about 1:20 by weight. Where at least two metal species are present in the metal powder, a first species may be copper and additional species may be one or more of aluminum, titanium, and zinc. The metal powder comprises metallic particles of any geometry. The particle shape of the metal powder may be substantially uniform or substantially heterogeneous. Preferably, the particle shape is substantially uniform/homogeneous. The particle shape may be substantially spheroid, ovoid, hemispherical, cuboid, cylindrical, toroid, conical, concave hemispherical (i.e., cup-shaped), plate- or tile-shaped, irregular, or may adopt any other desired three-dimensional conformation. The particle size of the metal powder may be substantially uniform or substantially heterogeneous. Preferably, the particle size is substantially uniform/homogenous. The particles may have an average major dimension of about 100 microns or less, about 50 microns or less, about 30 microns or less, about 20 microns or less, about 15 microns or less, about 10 microns or less, about 5 microns or less, about 2 microns or less, or about 1 micron or less.

The blend of collagen and metal powder is subsequently formed into a shaped body. The shaped body may be formed by filling a mold with the liquid blend and freezing the mold, or by otherwise placing the blend or any portion thereof into conditions adequate for freezing. For example, the blend may be introduced dropwise into liquid nitrogen in order to form frozen droplets, the frozen droplets being the shaped bodies; this approach permits the formation of roughly spherical or substantially spherical metallic structures. The formation of the shaped body by freezing anchors or sets the orientation of the collagen fibers in the shaped body. The shaped body itself and the porous metallic structure formed therefrom may adopt any three dimensional configuration. The mold into which the liquid blend of collagen, metal powder, and carrier is placed may substantially correspond to the three dimensional configuration of the final porous metal structure, although it is not unusual for some shape changes to occur during the processing stages that are carried out in order to yield the final product. In any event, the shaped body, the final porous metal product, or both, may be substantially spheroid, ovoid, hemispherical, cuboid, cylindrical (any type within a wide range of aspect ratios), toroid, conical, concave hemispherical (i.e., cup-shaped), plate- or tile-shaped, irregular, or may adopt any other desired three-dimensional conformation.

In another embodiment the shaped body may be formed from the blend by applying the blend to a one or more portions of a substrate, followed by freezing the substrate and the blend that has been applied to the substrate. For example, the shaped body may be formed by daubing, painting, spraying, pouring, dripping, or coating the blend onto a substrate, followed by freezing the substrate/blend. Alternatively, the substrate may be dipped into the blend in order to form a coat of the blend on the portion of the substrate that has been dipped, followed by freezing. Preferably, the substrate is subjected to freezing conditions prior to application of the blend, such as by dipping the substrate in liquid nitrogen. The substrate may be a solid object having a defined geometry, and as such the substrate may be substantially spheroid, ovoid, hemispherical, cuboid, cylindrical, toroid, conical, concave hemispherical (i.e., cup-shaped), plate- or tile-shaped (solid or perforated), irregular, or may adopt any other desired three-dimensional conformation. For example, the blend may be applied to an object that is intended for use as an orthopedic implant, such as an acetabular body for use in a hip implant. The substrate may also be a screen or a mesh, such as a metal screen or mesh. For example, the coating of screens may be performed in order to lay down a catalyst coating for use in reactions, such as photocatalytic oxidation. The substrate may be substantially non-porous or may be porous with respect to any portion or the entirety thereof.

When the shaped body is formed by applying the blend to a substrate, processing steps that are described herein with respect to the "shaped body" refer to the blend that has been applied to a substrate. For example, in such instances, the heating of the shaped body to a temperature above the eutectic will refer to the heating of the blend as applied onto substrate. Preferably, the substrate comprises a material that will remain substantially intact after being exposed to the conditions that are required to reduce the amount of carrier in the shaped body (such as sintering conditions). As such, the substrate preferably comprises one or more of metal, ceramic, glass, or any other suitable substance or combination of substances.

The formation of a shaped body by applying the blend to a substrate can be used to provide a final product that features a porous metallic coating on the substrate. Depending on the characteristics of the porous metallic coating (e.g., its chemical composition, pore volume, pore size, strength, thickness, etc.) and the substrate, the coated substrate can be used for any of a number of different purposes. For example, the coated substrate may be used as a catalyst. In another example, the coated substrate may be used as an orthopedic implant; the porous metallic coating may provide surface roughness and porosity that is conducive to implant stability, durability, and biocompatibility, and may contribute to tissue ingrowth.

Following the formation of the shaped body from the blend of collagen, metal powder, and carrier, the shaped body may be heated to a temperature above the eutectic point of the blend. In order to create specific pore sizes and matrix morphology, heating the shaped body to a temperature above the eutectic allows for a process of controlled meltback. In this process, the frozen shaped body is heated and held at a given temperature for a certain amount of time. This process induces a chemical potential which causes the viscous collagen-rich mobile phase to become rearranged such that it at least partially coats ice particles present in the blend. Upon refreezing and subsequent reduction of the amount of solvent in the shaped body, e.g., by freeze-drying, pores are formed. The eutectic temperature and the phase diagram are determined for a given formulation contained within a shaped body, for example by use of Differential Scanning Calorimetry. The induced chemical potential in terms of non-equilibrium, mobile phase pH is calculated by overlaying the processing conditions onto the determined phase diagram. An exemplary process of this variety is described in Example 4, infra. Pore size of the final porous metallic structure can be calculated in relation to the pore size in the shaped body. The relationship between pore size in the shaped body and pore size in the porous metallic structure has been observed to be linear. For example, using the above-described process of heating the shaped body to a temperature above the eutectic point of the blend, it was observed that pores having an average major dimension of about 100 μm that were present in a substantially spherical shaped body with a diameter of about 2000 μm became pores having an average major dimension of about 20 μm in the final porous metallic structure, which after sintering had been reduced to a diameter of about 750 μm. However, some variation of this relationship may occur and such variations are within the scope of the present invention. The relationship between pore size in the shaped body and pore size in the porous metallic structure may deviate from the observed relationship when, for example, there are dramatic reductions in volume during sintering, such as when the metal-to-collagen ratio in the shaped body is low (e.g., from about 0.5:1 to about 5:1).

The phase diagram for each formulation within a shaped body is different depending on the specific surface area of the collagen nanofibrils and metal powder, the concentration of the collagen nanofibrils and metal powder, the type of metal powder, the type and amount of acid, the source and type of the collagen, and the type and amount of any additives. Prior to processing the phase diagram specifics are determined using a Differential Scanning Calorimeter. A pulsed NMR technique, developed by Anderson & Tice of the U.S. Army Cold Regions Research and Engineering Laboratory (CRREL) in Hanover, N.H. (and typically used for soils) has also been successfully used to determine the specifics of the phase diagram. Those skilled in the art will readily appreciate the process for determining a phase diagram and the appropriate eutectic for a formulation contained within a given shaped body.

The heating of the shaped body above the eutectic occurs at a temperature and for a time that is dependent upon the characteristics of the constituents of the shaped body. In general, however, the heating of the shaped body above the eutectic may occur for about 0.5 to about 48 hours, preferably for about 1 to about 18 hours, about 2 to about 12 hours, about 3 to about 8 hours, or about 3 to about 6 hours. The temperature above the eutectic at which the shaped body is heated is typically about −5° C. to about −40° C., about −10° C. to about −35° C., or about −25° C. to about −30° C. For example, the temperature at which the shaped body is heated may be about −5° C., about −7° C., about −10° C., about −15° C., or about −20° C. The duration and temperature of heating constitute a kinetic relationship whereby the pores of the resulting structure develop from the original dispersion.

Following the period of time during which the shaped body is heated to a temperature above the eutectic, the shaped body is cooled to a temperature below the eutectic point of the blend. The cooling of the shaped body at a temperature below the eutectic occurs at a temperature and for a period of time that is sufficient to cause each of the components of the blend to be present in the solid phase (and thereby anchor the reformed structure and morphology).

After the shaped body is cooled to a temperature below the eutectic (or after the formation of a shaped body if heating above the eutectic followed by cooling is not performed), the amount of solvent in the shaped body is reduced. The reduction of the amount of solvent may be achieved by sublimation of the solvent, for example, via freeze drying/lyophilization. The amount of solvent in the shaped body is reduced by at least 50% or more, for example, by at least 60%, at least 70%, at least 80%, at least 90%, at least 95%, or at least 99%. Vacuum freeze drying may be used to reduce the amount of solvent in the shaped body, and those skilled in the art will readily appreciate the conditions under which vacuum freeze drying may be achieved. In any event, the temperature during freeze drying should not exceed the eutectic of the sample.

After the amount of solvent is reduced in the shaped body, crosslinking of the collagen in the shaped body may optionally be performed. Crosslinking serves to set the pore size and morphology of the structure. The collagen can be crosslinked using either chemical crosslinking agents preferably selected from the group consisting of a carbodiiamide or N-hydroxy succinimide-derived active esters (succinimidyl active esters), by severe dehydration at an elevated temperature and high vacuum, by enzymatic crosslinking (see Lastowka A, et al., *A Comparison of Chemical, Physical, and Enzymatic Crosslinking of Bovine Type I Collagen Fibrils, Journal of the American Leather Chemists' Association*, Vol. 100, No. 5, May 2005, pp. 196-202) or by any combination of these treatments. The strength and biostability of the collagen matrix so prepared is influenced by the degree of crosslinking introduced through such treatment.

When using such chemical crosslinking agents, the dry collagen matrix material is immersed in a solution of the crosslinking agent at about room temperature for a period of time of from about 2 to 96 hours. The solution of crosslinking agent may contain from about 0.1 to about 15% (weight per volume) of the crosslinking agent. Alternatively, the crosslinking agent could be added to the original solution or dispersion of the collagen source.

To crosslink the collagen matrix using severe dehydration (also known as dehydrothermal crosslinking) the shaped body is subjected to full vacuum of about 50 millitorr or less for about 1 hour to about 2 weeks at a temperature in the range of about 100° C. to about 130° C. In a preferred embodiment, dehydrothermal crosslinking is performed for about 1 hour to about 12 hours at a temperature of about 100° C. to about 130° C., preferably about 100° C. to about 110° C. Dehydrothermal crosslinking is preferred over chemical crosslinking, because when the latter treatment is used, it may be necessary to wash the shaped body in order to remove any excess crosslinking agent, depending on the end use of the final porous metallic structure.

After crosslinking, the shaped body may optionally be washed and/or stored in ultra-pure water, and the shaped body may optionally be sterilized using conventional sterilization techniques; however, it has been discovered that the dehydrothermal crosslinking process, especially when performed for as long as 14 days, can satisfactorily sterilize the shaped body, thus obviating the need for any additional treatment.

A major proportion of the collagen nanofibrils in the lyophilized shaped body are then removed. The total mass proportion of collagen nanofibrils that are removed from the shaped body may be at least 2%, at least 10%, at least 20%, at least 25%, at least 40%, at least 50%, at least 60%, at least 70%, at least 75%, at least 80%, at least 90%, at least 95%, at least 97%, at least 99%, at least 99.9%, or at least about 100%. The removal of the major proportion of collagen nanofibrils is preferably accomplished by sintering the shaped body. The sintering temperature may be from about 400° C. to about 2000° C., preferably at least about 600° C. For example, the sintering may be performed at a temperature of about 400° C., about 500° C., about 600° C., about 700° C., about 800° C., about 900° C., about 1000° C., about 1100° C., about 1200° C., about 1400° C., about 1600° C., about 1800° C., or about 2000° C. The duration of the sintering may be about 1 to about 12 hours, preferably about 1, about 3, about 6, about 8, about 10, or about 12. Traditional powder metallurgy involves sintering under inert atmospheric conditions, e.g., in a nitrogen atmosphere. The removal of a major proportion of the collagen nanofibrils may therefore involve sintering under inert atmospheric conditions, or under ambient atmospheric conditions (i.e., 78.08% nitrogen, 20.95% oxygen, 0.93% argon, 0.038% carbon dioxide).

Pursuant to the removal of collagen nanofibrils from the shaped body, sintering may be preceded by a flash heating step, whereby the shaped body is rapidly exposed to temperatures that are elevated relative to the temperature of the shaped body itself. Flash heating may involve exposing the shaped body to a temperature that is from the ambient atmospheric temperature of the processing environment (e.g., room temperature) up to about 1800° C. For example, flash heating may be accomplished by exposing the shaped body to room temperature conditions, or to conditions having a temperature of 400° C., 600° C., 800° C., 1000° C., 1200° C., 1400° C., 1600° C., or about 1800° C. The duration of the flash heating may be from about 10 minutes to about 8 hours, preferably from about 1 hour to about 4 hours.

The sintering step, described above, may follow immediately after flash heating, and typically involves exposure of the shaped body to temperatures that are elevated above those employed during flash heating. The rate of temperature increase from the flash heating step to sintering may be about 200° C. per hour to about 500° C. per hour.

Following the optional flash heating and the sintering step, the shaped body will have been converted to a porous metallic structure comprising sintered metal that is arranged in accordance with the sacrificed collagen scaffold. The resulting porous metallic structure may be cooled, for example, by natural convection in situ or by direct immersion in a liquid, such as water. The average pore size of the instant porous metallic structures may be from about 0.1 micron to about 250 microns. Pore size may be determined using any suitable technique, including, for example, scanning electron microscopy or transmission electron microscopy and measurement software. For example, an image of a porous metallic structure is captured, and the image is used to measure pore size, count the total number of pores measured, and calculate an average pore size. The average pore size of a porous metallic structure in accordance with the present disclosure may be about 0.1 micron, about 0.5 micron, about 1 micron, about 5 microns, about 10 microns, about 20 microns, about 50 microns, about 75 microns, about 100 microns, about 200 microns, or about 250 microns. The average porosity, i.e., the percentage of void space within a porous metallic structure, may be at least about 80%, at least about 85%, at least about 90%, at least about 95%, at least about 97%, or at least about 99%. Average porosity may be determined gravimetrically, by weighing a porous metallic structure comprising a known metal or metals and comparing the density of the weighed structure to established metal densities.

The density of a porous metallic structure may be about 0.5 g/mL to about 10 g/mL, preferably about 1 g/mL to about 7 g/mL. It has presently been discovered that the diameter and density of a porous metallic structure in accordance with the present disclosure may be controlled by varying the metal to collagen ratio in the blend of collagen, metal, and carrier that is used to form a shaped body. In particular, a higher metal to collagen ratio results in less densification of the shaped body during the removal of the major proportion of collagen nanofibrils, and consequently results in a porous metallic structure having a greater diameter than a different structure that was made by a process that employed a lower metal to collagen ratio. FIG. 1 illustrates how the degree of densification that occurs during the preparation of substantially spherical porous metallic structures in accordance with the present disclosure is at least partially a function of the metal to collagen ratio ("M/C ratio") that is used during the production process. Four different shaped bodies of substantially equal diameter, each containing a different metal to collagen ratio, were subjected to conditions sufficient to remove a major proportion of the collagen nanofibrils (here, sintering), and the final diameter of each shaped body was measured during sintering. All of the shaped bodies evinced a reduction in diameter when sintered, but the structures having a lower metal to collagen ratio underwent a greater degree of densification and commensurate reduction in diameter relative to the structures formed from a mixture having a higher metal to collagen ratio.

The strength rating of the porous metallic structures may be about 100 to about 1000 grams load bearing per structure. Example 2, infra, describes the conditions under which the relative strength of porous metallic structures may be determined. As used herein, the "strength rating" represents a relative measurement and corresponds to the number of grams required for a porous metallic structure in accordance with the present disclosure to fail (crush).

Thus, in another aspect, there are also disclosed structures comprising a porous metallic matrix having a strength rating of about 50 to about 2000 grams; an average pore size of about 5 to about 100 microns; a density of about 1 g/mL to about 7 g/mL; and, an average porosity of at least about 90%. As described previously, a shaped body that is used to form a porous metallic matrix may be any three-dimensional shape, as may the porous structure that is produced from a shaped body. For example, the porous structure may be substantially spheroid, ovoid, hemispherical, cuboid, cylindrical, toroid, conical, concave hemispherical (i.e., cup-shaped), plate- or tile-shaped, irregular, or may adopt any other desired three-dimensional conformation. The structures comprising a porous metallic matrix may further comprise a substrate. As described previously, a shaped body may be formed by applying the blend of collagen nanofibrils and metal powder onto one or more portions of a substrate, and following subsequent processing steps, the structure that results may comprise a porous metallic matrix and the substrate. The substrate may have characteristics in accordance with the preceding disclosure. With respect to the instant structures, the porous metallic matrix may be present on one or more surfaces of the substrate. For example, the porous metallic matrix may comprise a coating on one or more surfaces of the substrate. A "surface" of the substrate may be an external face of the substrate or may be an internal portion of a substrate, such as the inside of a substantially hollow spherical substrate or one or more portions of the concave face of a cup-shaped substrate.

Also in accordance with the preceding disclosure, the porous structure may comprise any metal or metals that are chemically stable within the collagen dispersion, e.g., prior to the formation of the shaped body. For example, the porous structure may comprise one or more of aluminum, copper, stainless steel, titanium, iron, chromium, manganese, tin, iron, and zinc. The porous structure may comprise a single metal species, or may comprise at least two different metal species. When the porous structure comprises at least two different metal species, the ratio of the first metal species to a second metal species in the porous structure may be about 1:1 to about 1:20 by weight. For example, the porous structure may comprise a first metal species and a second metal species in a ratio of about 1:1, about 1:2, about 1:5, about 1:9, about 1:10, about 1:15, or about 1:20 by weight. Where at least two metal species are present, a first species may be copper and additional species may be one or more of aluminum, titanium, and zinc. When the porous structure comprises at least two metal species, the individual species may be substantially homogeneously spatially distributed throughout the structure. For example, the porous structure may comprise a substantially homogeneous distribution of a first metal and a second metal. Sufficient blending of the mixture of metal powder, collagen, and carrier during the production of the porous structure is one acceptable way to achieve a substantially homogeneous distribution of the components of that mixture, and subsequent formation of the shaped body "locks" the spatial distribution of the various components in place.

EXAMPLES

Example 1

Table 1, below, provides a listing of various conditions under which porous metallic structure were produced. Under various processing conditions, the porous structures were respectively made from aluminum, copper, stainless steel, titanium, zinc, and mixtures of aluminum and copper, titanium and copper, and zinc and copper. "M/C ratio" refers to the ratio of metal to collagen in the blend used to form the respective shaped bodies. Crosslink testing was performed with respect to some embodiments, and all embodiments were made using a flash heating and sintering process in order to remove a major proportion of the collagen nanofibrils in the respective shaped bodies.

TABLE 1

| | |
|---|---|
| **Aluminum** | |
| M/C ratio | 1:1, 5:1, 10:1, 20:1 |
| Flash ° C. | ambient, 400 |
| Sintering ° C. | 600, 900, 1100 |
| Sinter Duration (hrs) | 1, 3, 6 |
| **Copper (with crosslink testing)** | |
| M/C ratio | 1:1, 5:1, 10:1, 20:1 |
| Flash ° C. | ambient, 400 |
| Sintering ° C. | 600, 1100 |
| Sinter Duration (hrs) | 1, 3, 6 |
| **Stainless Steel** | |
| M/C ratio | >20:1 |
| Flash ° C. | ambient, 600 |
| Sintering ° C. | 1000, 1200 |
| Sinter Duration (hrs) | 1, 6 |
| **Titanium (with crosslink testing)** | |
| M/C ratio | 1:1, 5:1, 10:1, 20:1 |
| Flash ° C. | ambient, 600, 1200 |
| Sintering ° C. | 600, 1000, 1200 |
| Sinter Duration (hrs) | 1, 8 |

TABLE 1-continued

| | |
|---|---|
| **Zinc** | |
| M/C ratio | 1:1, 5:1, 10:1, 20:1 |
| Flash ° C. | ambient, 400, 600 |
| Sintering ° C. | 400, 600, 1100 |
| Sinter Duration (hrs) | 1, 3 |
| **Aluminum/Copper** | |
| M/C ratio | 10:1 |
| Flash ° C. | 600 |
| Flash Duration (hrs) | 3 |
| Sintering ° C. | 600, 1000, 1200 |
| Al/Cu ratio | 1:1 |
| **Titanium/Copper (with crosslink testing)** | |
| M/C ratio | 10:1 |
| Flash ° C. | 600 |
| Flash Duration (hrs) | 1, 2 |
| Sintering ° C. | 600, 800, 1200 |
| Ti/Cu ratio | 1:1 |
| **Zinc/Copper** | |
| M/C ratio | 10:1 |
| Flash ° C. | 400 |
| Flash Duration (hrs) | 1, 3 |
| Sintering ° C. | 600, 900, 1000 |
| Zn/Cu ratio | 1:1, 1:9, 9:1 |

Figure 2:
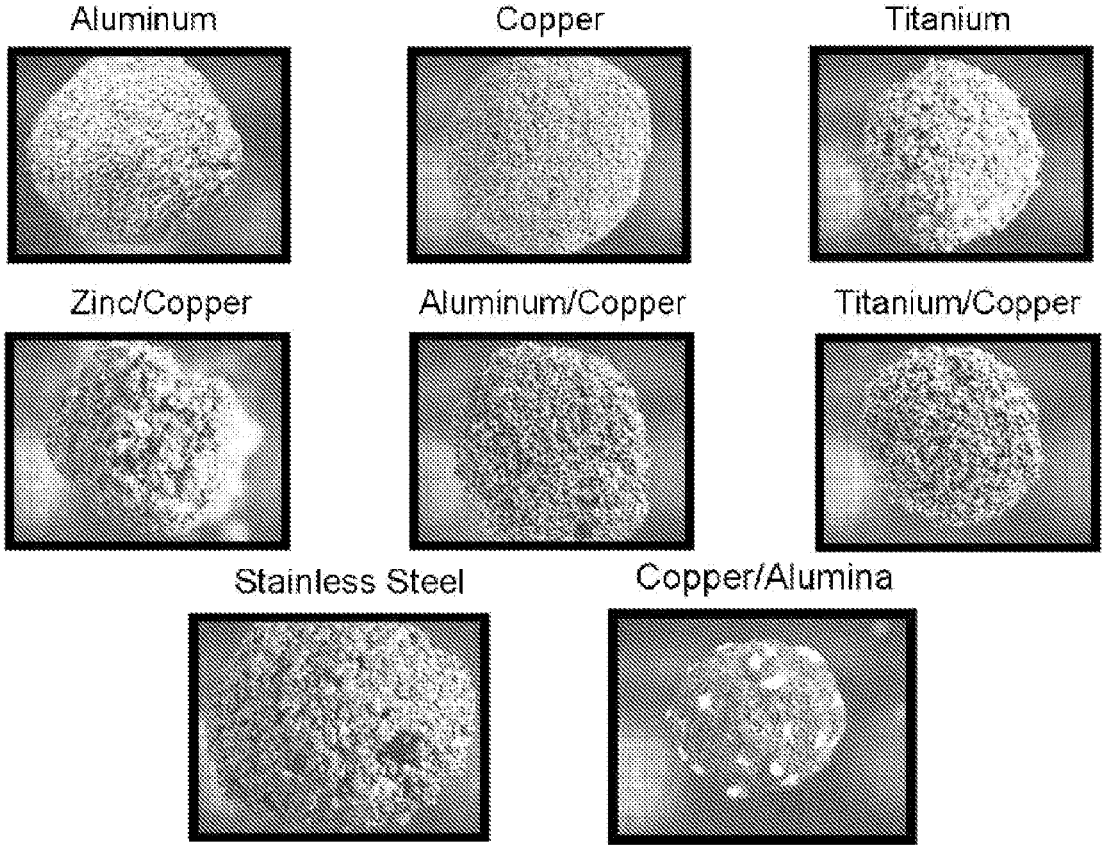
FIG. 2 provides images of porous metallic structures produced in accordance with the present disclosure.

FIG. 2 provides images of porous metallic structures produced in accordance with the present disclosure. Images were acquired using a light microscope. Because optical microscopes have a shallow depth of focus, a series of images at different "depths" of each metallic structure were acquired, stored, and digitally layered using Adobe Photoshop CS2® (Adobe Systems Incorporated, San Jose, Calif.); the images in FIG. 2 are therefore enhanced composites.

Example 2

Strength Testing

Figure 3:
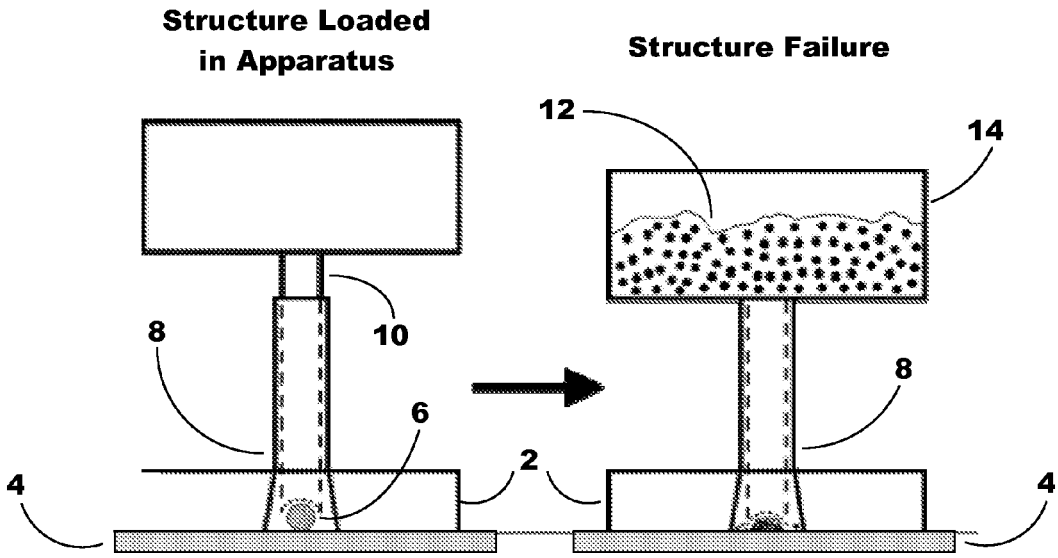
FIG. 3 depicts a schematic of a vertical piston crush test apparatus used to determine the relative strength of porous metallic structures.

A method was developed for determining the relative strength of samples formed using a variety of metals and under different processing conditions. A custom vertical piston crush test apparatus was manufactured, and consisted of two plastic packing end caps from a cylindrical item, a large two-part rivet, two washers and a machine screw with a concave end. A schematic of the testing device is depicted in FIG. 3.

The experimental method for this device involved placing the base portion 2 of the device on a laboratory scale 4. The porous structure 6 for testing was deposited into the device via a hollow shaft 8 connected to the base portion 2. The laboratory scale 4 was zeroed, and an upper piston shaft 10 was inserted into hollow shaft 8 and brought into a resting position on top of the structure 6. Weight 12 in the form of metal ball bearings was gradually added into the top cup 14 of the device until the point at which the structure collapses. The reading on the scale 4 at the time of the collapse of structure 6 corresponds to the structure's "strength rating".

Figure 4:
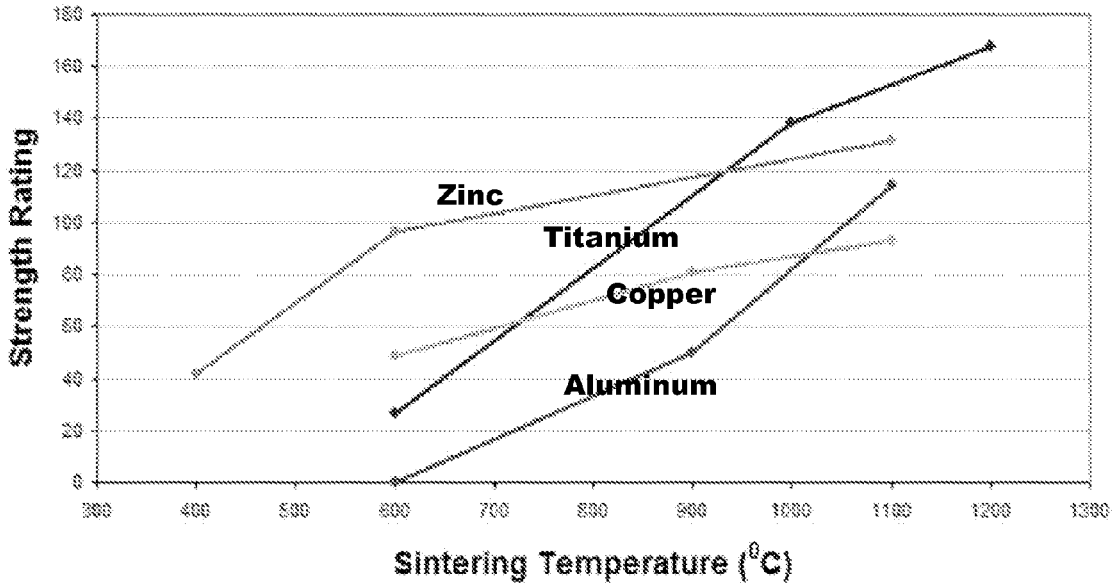
FIG. 4 provides strength testing data for inventive porous metallic structures comprising a single metal species.
Figure 5:
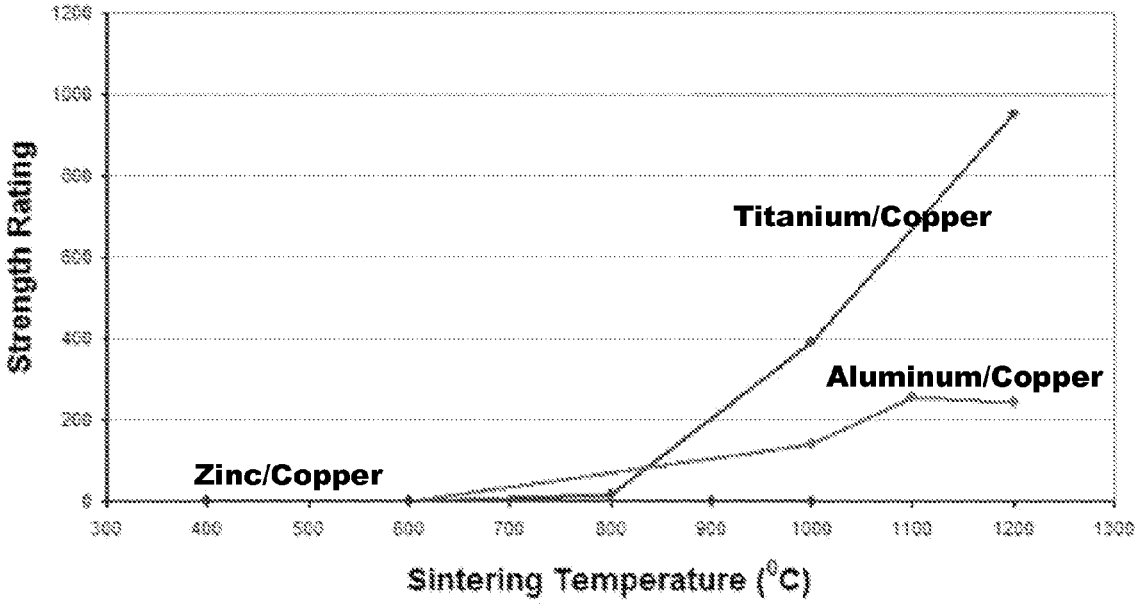
FIG. 5 provides strength testing data for inventive porous metallic structures comprising two different metal species.

A series of tests across the sample set were carried out using the vertical piston device. All but one of the production parameters was held constant in order to determine the relative strength of the porous structures. Results are provided in FIGS. 4 and 5 and are expressed in terms of strength rating versus sintering temperature. As used herein, the "strength rating" represents a relative measurement and roughly translates into the number of grams required for the porous structure to fail (crush). Each of the data points in FIGS. 4 and 5 represents an average value of multiple samples tested with respect to a particular set of parameters. Experimental errors were small relative to data values and are not depicted. FIG. 4 provides data for structures comprising a single metal species, while FIG. 5 provides data for structures comprising two different metal species. In FIG. 5, the results for the hybrid zinc/copper structures are depicted as a set of data points along the x-axis; these structures had a strength below the minimum baseline.

The trend for all trials was such that strength was positively correlated to sintering temperature, the only exception being the aluminum/copper hybrid structure, which experienced a decrease in strength between 1100° C. and 1200° C. Some of the factors that contribute to the samples' performance in these trials are particle size of the metal powder, extent of sintering, melting point, and chemical reactivity of the constituent ingredients. Table 2, below, shows the strongest structures from each study and the applicable sintering conditions.

TABLE 2

Top Strength Test Results

| Metal/Alloy | Strength Rating | Sintering Temp ° C. |
|---|---|---|
| Stainless Steel | 998 | 1200 |
| Titanium/Copper | 953 | 1200 |
| Aluminum/Copper | 257 | 1200 |
| Titanium | 168 | 1100 |
| Zinc | 132 | 1100 |
| Aluminum | 114 | 1100 |
| Copper | 93 | 1100 |
| Zinc/Copper | (Below Threshold) | 1000 |

For many uses, the strength of a porous metallic structure is not the only relevant criterion; morphology of the pores and integrity of the mesh structure may also be important. The characteristics of the metal powder particles used in the production process seemed to influence the characteristics of the resulting porous structure. As particle size increased, there was a corresponding increase in the strength of the resulting porous structure, but there was some decrease in the quality of pore architecture.

The lowest strength performer of the structures formed from a single metal species, that which was made from copper alone, consisted of very fine particles and displayed an even pore structure over its surface (see FIG. 2). In contrast, the titanium structures, which consisted of comparatively larger particles, performed well in the strength testing but had a less desirable architecture. The aluminum structures, with their medium particle size, had a performance rating that ranked between that of the copper and titanium structures under both criteria, and the zinc structures that performed rather well in strength testing had a less consistent, "rockier" pore structure (see id.).

As for the structures that were made from more than one metal species, although the stainless steel spheres (metal to collagen ratio>20:1) performed very well in strength testing, their porous architecture was dense and compacted (see FIG. 2). The titanium/copper hybrid, which performed nearly as well in strength testing as the stainless steel embodiments, evinced a rich and even pore structure. The aluminum/copper structures also performed well in the strength tests and included an even pore structure. Finally, the zinc/copper structures performed very poorly in strength testing, but seemed to have a well-distributed structure (see id.).

Strength ratings were also higher for structures that included more than one metal species as compared structures made from a single species. Tables 3 and 4, below, provides a comparison between the strength ratings measured with respect to structures made from two metal species and structures made from one of such species but not the other.

TABLE 3

| | Aluminum | Copper | Aluminum/Copper Hybrid |
|---|---|---|---|
| Strength Rating | 114 | 93 | 241 |

TABLE 4

| | Titanium | Copper | Titanium/Copper Hybrid |
|---|---|---|---|
| Strength Rating | 168 | 93 | 953 |

Example 3

Durability Testing

Figure 6:
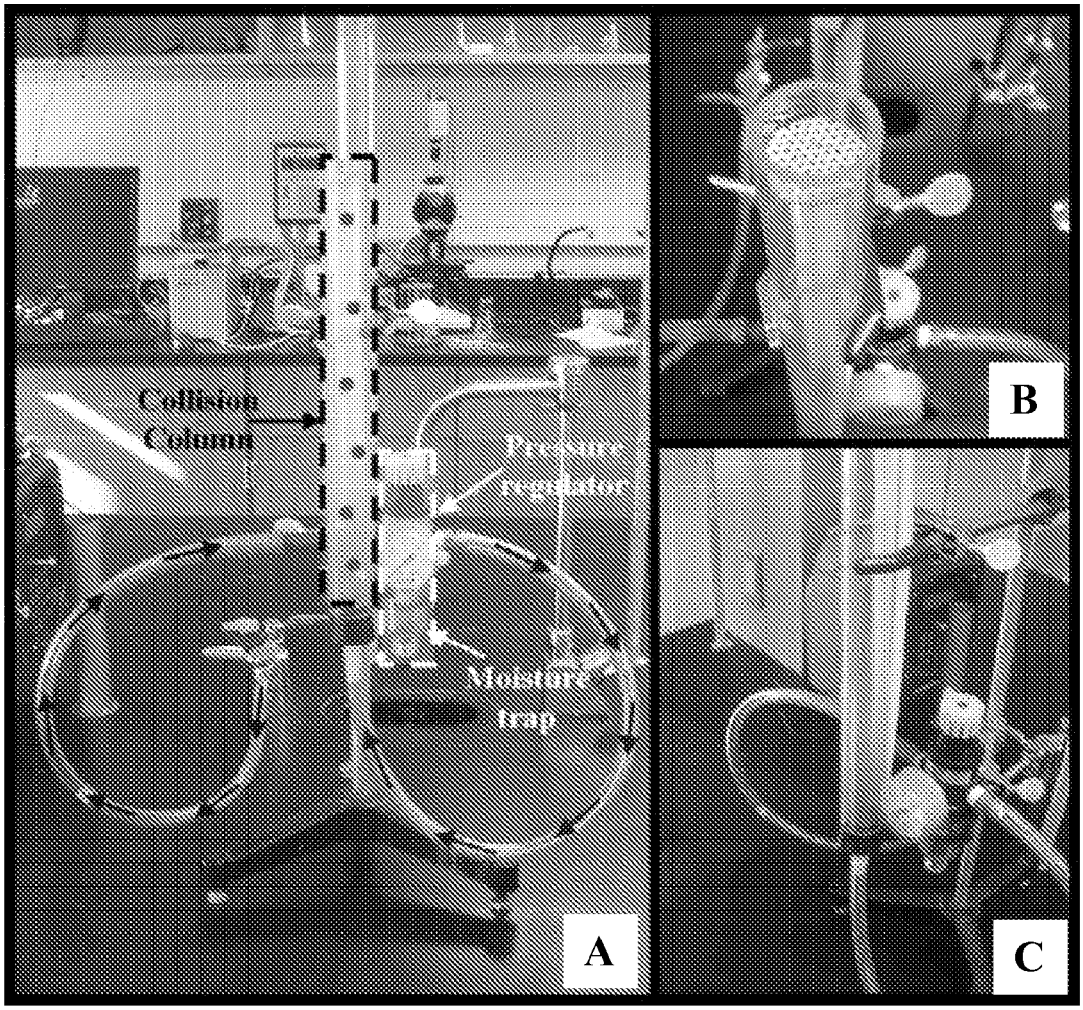
FIG. 6 depicts an apparatus used to test the rate at which porous metallic structures in accordance with the present disclosure deteriorate when subjected to repeated high-speed collisions.

A method was developed for determining the relative durability of samples formed using different metals and processing conditions. Durability was defined in terms of a sample's ability to withstand a fluidized environment. The experimental method tested the rate at which porous metallic structures in accordance with the present disclosure deteriorated when subjected to repeated high-speed collisions, with each other and with the walls of the test column itself. A custom fluidized collision column was fabricated. It consisted of an acrylic cylinder, three lengths of ⅜" tubing, a pressure regulator, a moisture trap, two modified stoppers, two circular screens, and a pressurized air supply (see FIG. 6A). FIGS. 6B and C provide additional views of the testing apparatus.

In operation, air passes through the regulator into the bottom of the column, passes through the bottom screen, and fluidizes the porous structures. The top screen prevents the structures from escaping, while the exhaust tube transfers particles that are shed from the structures to a filter that traps the particles for disposal. For ease of data measurement, substantially spherical structures were tested. The experimental method consisted of measuring the diameter of each sphere, introduction of the sample spheres into the column, activating the air supply and slowly adjusting the regulator until the structures evenly travel the full height of the test column, allowing the structures to collide with each other and with the walls of the column for a measured period of time, removal of the structures from the column, and measuring the diameter of each sphere.

A short series of tests to determine the durability of some exemplary structures was carried out using the fluidized collision device. Only structures made from stainless steel and titanium/copper, respectively, were eligible for the testing, as structures made from other metals performed below the threshold (exhibiting near immediate failure) in preliminary testing. The average diameter of a 12 total structures was measured at the start of testing and recorded incrementally thereafter to determine the rate of structural attrition when subjected to repeated high speed collisions.

Figure 7:
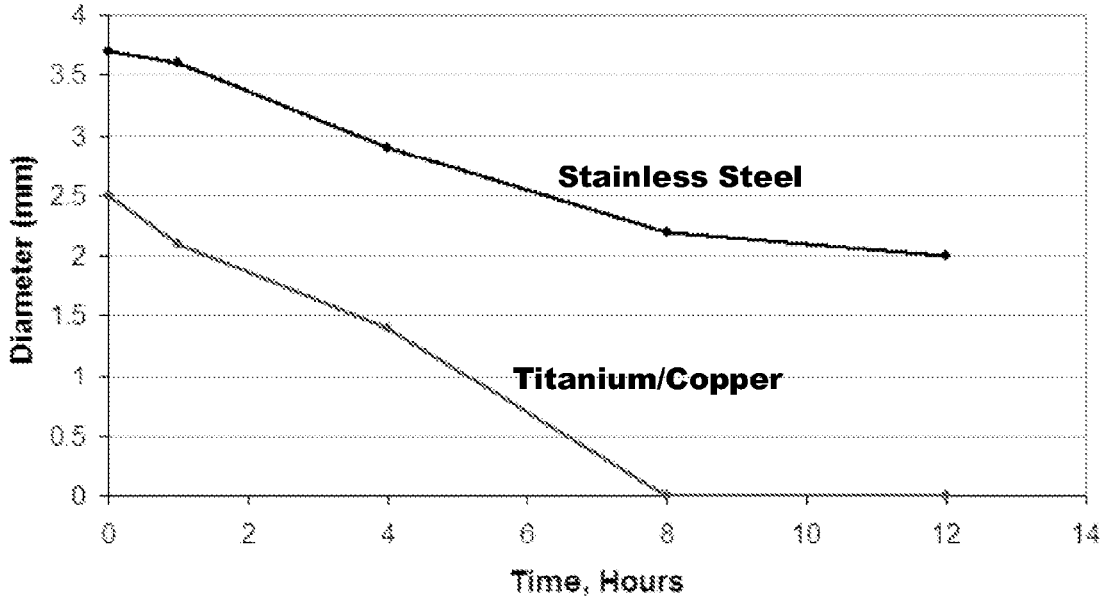
FIG. 7 depicts the results of durability tests, expressing average sphere diameters as a function of the amount of time spent in the testing apparatus.

FIG. 7 depicts the results of the durability tests, expressing average sphere diameters as a function of the amount of time spent in the testing apparatus. The results obtained for the durability study demonstrated that the stainless steel spheres slowly diminished in diameter over the testing period of twelve hours. The stainless steel structures had an average diameter 3.7 mm at the beginning of the testing period, and had an average diameter of 2 mm following testing. It also appeared as though there was a decrease in the rate at which the stainless steel structures lost mass as the end of a given trial, indicating that the strength of adhesion between the metal particles of which the structure consists was greater than the force of collision at the diminished mass, i.e., as the structures lose mass, the force generated upon collision was no longer sufficient to dislodge particles. In contrast, the titanium/copper structures were entirely destroyed at the end of an 8 hour testing period; no particles or large remnants of the titanium/copper structures remained in the column following the test period.

Example 4

Heating a Shaped Body Above the Eutectic to Control Pore Size and Morphology An exemplary collagen dispersion may consists of 3 major constituents plus additives. The relative quantities may be as follows:

| | |
|---|---|
| collagen nanofibrils | 1 parts by mass |
| acetic acid | 5 |
| water | 94 |
| additives | 0-50 (relative to collagen) |

The dispersion plus additives are processed by rapidly freezing the desired material below the eutectic temperature and then freeze drying. The resulting pore size and morphology consists of a regular matrix of <5 micron pore diameters and wire-like collagen structure.

In order to create specific pore sizes and matrix morphology, the process of controlled meltback is used. In this process, the dispersion formulation described above is frozen rapidly to a temperature well below the eutectic temperature. The frozen dispersion is then reheated and held at a given temperature for a certain amount of time. This process induces a chemical potential which causes the viscous collagen-rich mobile phase to coat the ice particles. Upon refreezing and subsequent freeze drying the pores are created.

Figure 8:
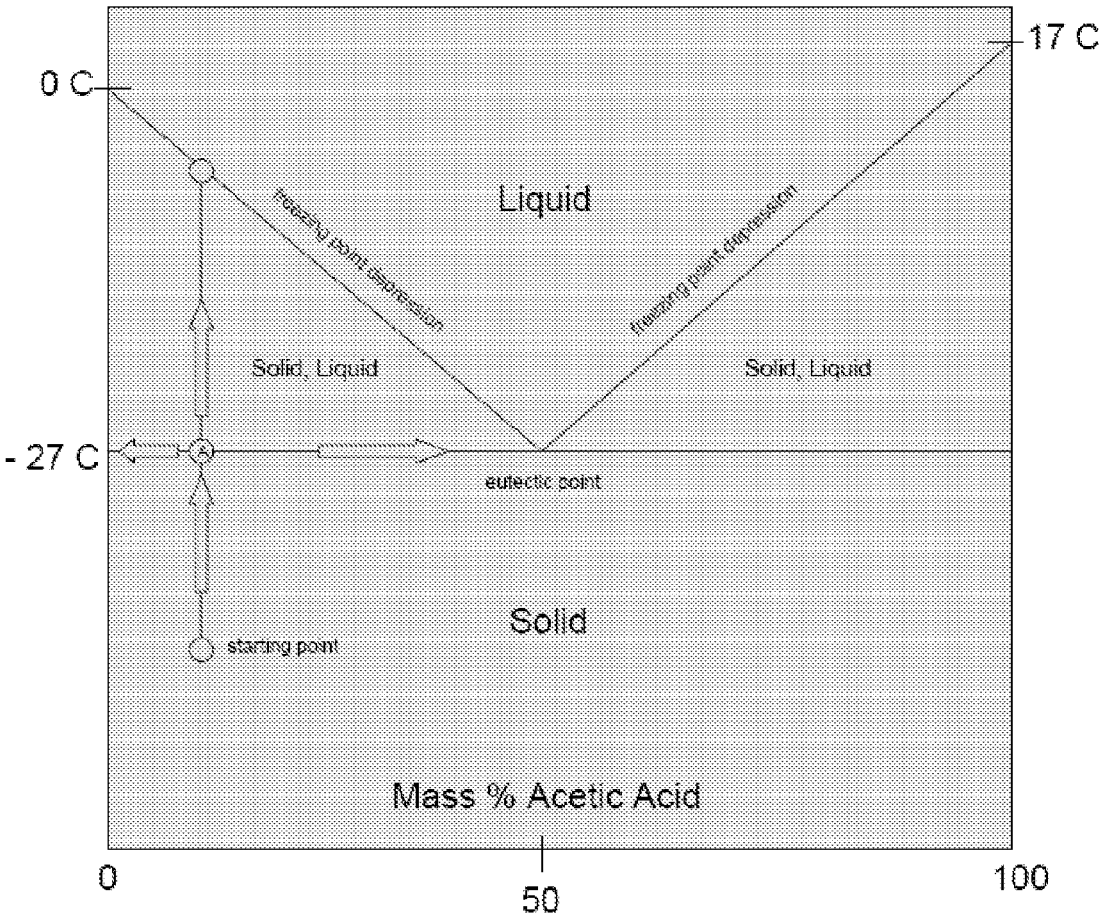
FIG. 8 provides an exemplary phase diagram that is used to determine the processing conditions for the optional partial meltback of a shaped body.

The eutectic temperature and the phase diagram are determined for each formulation by Differential Scanning Calorimetry (DSC). An exemplary phase diagram is provided in FIG. 8. The induced chemical potential in terms of non-equilibrium, mobile phase pH is calculated by overlaying the processing conditions onto the phase diagram.

A example of the conditions required to create certain pore sizes follows. The phase diagram for each dispersion is different depending on the specific surface area of the collagen nanofibrils, the concentration of the collagen nanofibrils, the type and amount of acid, and the type and amount of additive. Prior to processing the phase diagram specifics are determined using DSC. A pulsed NMR technique, invented by Anderson & Tice of the Cold Regions Lab in Hanover (and typically used for soils) has also bee successfully used to determine the specifics of the phase diagram.

Typical processing conditions are listed below for the production of a porous matrix with leafy morphology and 50 micron diameter pores.

Formulation

| | |
|---|---|
| Collagen Nanofibrils (porcine) | 1 part by mass |
| Acetic Acid | 5 |
| Water | 94 |
| Additives | 0 |

Processing

| | |
|---|---|
| Geometry | 3 mm spheres |
| Freezing temperature | −196° C. |
| Eutectic temperature | −27° C. |
| Soak temperature | −12° C. |
| Soak time, h | 16 |
| Refreeze temperature | −85° C. |
| Lyophilization | 3 days at high vacuum (<10 mT)<br>Condenser at −45° C.<br>Shelf temperature at −5° C. |
| Crosslinking | 5 days at full vacuum (<0.1 in. Hg) at a temperature of 113° C. |

In one specific example, the processing conditions were as follows:

| | | |
|---|---|---|
| eutectic temperature | −27° C. | from DSC |
| LHS Temperature | 0° C. | from DSC |
| RHS Temperature | 10° C. | from DSC |
| eutectic composition | 47% | from DSC |
| formulation composition | 5% | user input |
| soak temperature | −15° C. | user input |
| K acid | 1.80E−05 | unique to each acid |
| MW acid | 60 | unique to each acid |
| M original | 0.83 | mols/L calculated |
| pH original | 2.41 | calculated from equilibrium constant |
| FP line | slope | −0.57 |
| intercept | 0 | calculated from DSC info |
| concentration: soak Liquid | 26.11% | calculated from DSC info |
| M soak liquid | 4.35 | calculated from DSC info |
| pH soak liquid | 2.05 | calculated from DSC info |
| chemical potential | original pH<br>soak liq pH | 2.41<br>2.05 |
| percentage ice | 80.85% | |
| collagen mobile phase | 19.15% | |

| material balance | | original formulation | soak conditions | | |
|---|---|---|---|---|---|
| | collagen | 1 | 1 | | |
| | liq acid | 5 | 5 | | |
| | liq water | 94 | 13.15 | 26.11 | % acid re to CAW |
| | ice | | 80.85 | | |

Those skilled in the art will readily appreciate how such techniques may be applied to a shaped body that comprises metal powder in addition to collagen and carrier.

Example 5

Preparation of Coated Substrates

Substrates in the form of stainless steel metal screens were coated with a blend of collagen and titanium dioxide ($TiO_2$) metal powder to form screens that are coated with anatase- or brookite-$TiO_2$ and are suitable use as photocatalysts.

In an exemplary procedure, prior to coating with $TiO_2$ photocatalyst precursor, stainless steel screens were cleaned by soaking in 5% NaOH solution in deionized water, followed by rinsing with deionized water, soaking a second time in NaOH solution, and rinsing again.

Collagen dispersions were prepared by forming a mixture of deionized water and crude bovine corium (collagen type I, containing 10-15% collagen) and ball milling the mixture in a ceramic container using zirconium milling beads to unravel the collagen fibers. Ball milling speed maintained at 35 rpm for one week. The milled corium was sieved three times to remove unmilled corium, and the sieved, milled corium was centrifuged at 3000 rpm for one hour to recover collagen fibers as "collagen paste." Collagen paste was combined with deionized water and acetic acid at a desired ratio of collagen/acid/water, and was blended thoroughly to produce a collagen dispersion.

Catalyst precursor material was produced by blending titanium metal powder (Aldrich, Titanium, powder, −100 mesh, 99.7%) into the collagen dispersion. Catalyst precursor was drop-fed into liquid nitrogen to form spherical beads of frozen catalyst precursor. Frozen precursor beads were dehydrated by lyophilization for 72 hours.

Two different coating techniques were found to be suitable for producing $TiO_2$-coated screens. A first technique (A) included dipping a screen into liquid nitrogen, dipping into the solution of collagen and catalyst precursor, and submersion into liquid nitrogen to form a frozen coat of catalyst precursor. A second technique (B) omitted the first freezing step; screens were dipped into the solution of collagen and catalyst precursor and then submerged in liquid nitrogen to form a frozen coat of catalyst precursor.

To ensure complete removal of any bound moisture and to effect crosslinking, coated screens from were placed in a vacuum oven set at 110° C. in Hg for 8 hours. This process may optionally be omitted because the sintering process ordinarily burns off any excess moisture. There has been some indication that crosslinking cause some small shrinkage in the collagen marix and may then affect the ultimate morphology of the matrix.

To induce the formation of the brookite and anatase $TiO_2$ crystal morphologies, the coated screens were then sintered for a period of 1-5 hours, depending on the sample. It was expected that anatase would form on screens that had been sintered at 550° C., while brookite crystal structure would occur on screens that had been sintered at 300° C. Following such heat treatment, catalyst precursor was converted to catalyst. It is unlikely that all of the collagen will be removed by sintering at 300° C.

Figure 9:
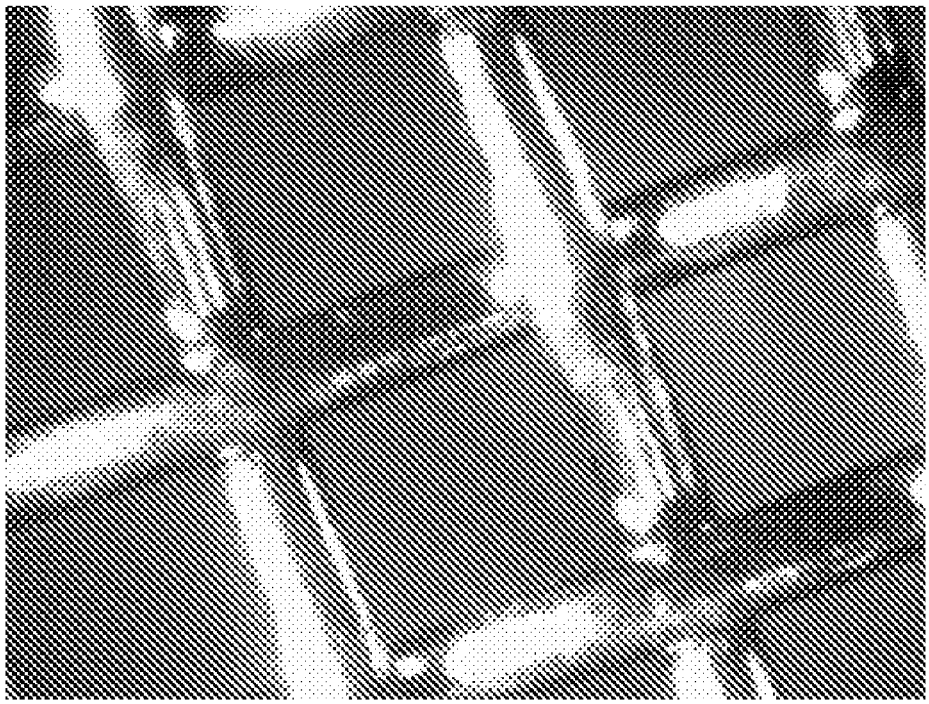
FIG. 9A depicts a microscope image of a portion of an uncoated stainless steel screen.
FIG. 9B shows a microscope image of a portion of that screen following coating with $TiO_2$ catalyst material.
Figure 9:
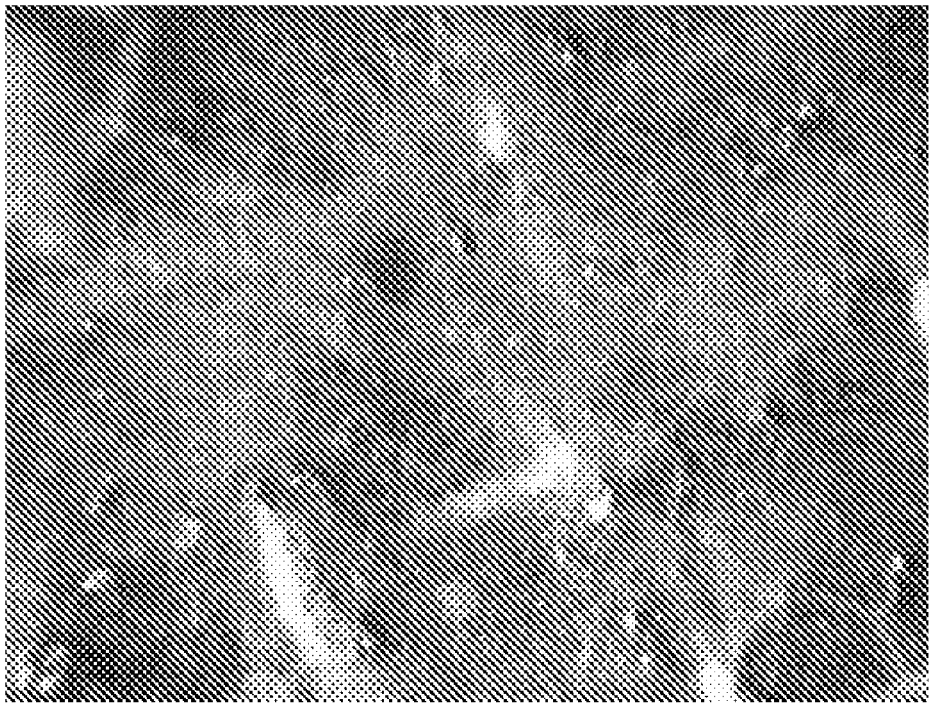

FIG. 9A depicts a microscope image of a portion of an uncoated stainless steel screen, and FIG. 9B shows a microscope image of a portion of that screen following coating with $TiO_2$ catalyst material.

Upon analysis of microscope images of the sintered and coated screens, it was observed that in some samples not all of the collagen had been burned off during sintering. The incomplete combustion of the collagen may have resulted from inadequate oxygen supply during sintering, inadequate length of sintering time, and temperature of sintering. Unexpectedly, it was also observed that the presence of residual collagen increased the strength of the adherence of the titanium dioxide photocatalyst to the stainless steel screen substrate. Without intending to be bound by any particular theory of operation, $TiO_2$ photocatalyst crystals may become enmeshed within the fibrous collagen, leading to an increase in the general cohesiveness of the $TiO_2$/collagen coating. An important property of the "coated screen" embodiment is to maintain the adherence of the sintered metal to the screen substrate after application. It has been found that at low sintering temperatures, the metal will adhere well to the substrate but will be contaminated with residual collagen. It was also found that at high sintering temperatures, the metal will stay on the substrate but may be of a different isomorph. For example, when the metal is titanium, at high sintering temperatures the form of the oxide may be rutile, which is less active than the anatase phase that is produced at a lower sintering temperatures. The present investigation included the discovery of the need for a balance between removal of residual collagen and the maintenance of the desired isomorph of titanium.

What is claimed:

1. A method for producing a porous metallic structure comprising the steps of:

blending a metal powder with a dispersion of milled collagen nanofibrils in a carrier to form a blend comprising a substantially homogeneous mixture of the metal powder, the collagen nanofibrils, and the carrier, wherein said collagen nanofibrils have an average diameter of about 10 nm to about 250 nm;

forming a shaped body from said blend;

heating said shaped body to a temperature above the eutectic point of the blend; cooling said shaped body to a temperature below the eutectic point of the blend;

reducing the amount of carrier in said shaped body; and removing a major proportion of said collagen nanofibrils from the shaped body.

2. The method according to claim 1 further comprising crosslinking said collagen nanofibrils in said shaped body prior to removing said collagen nanofibrils.

3. The method according to claim 2 wherein said crosslinking comprises dehydrothermal crosslinking.

4. The method according to claim 1 further comprising cooling said porous metallic structure following the removal of said collagen nanofibrils.

5. The method according to claim 1 wherein said carrier comprises an aqueous solution having a pH lower than 7.

6. The method according to claim 1 wherein said collagen nanofibrils are produced by:

providing a solution of raw corium, said corium comprising a plurality of bundled collagen fibers;

milling said solution of raw corium; and, optionally sonicating said milled solution of raw corium; and, recovering said collagen nanofibrils from said solution.

7. The method according to claim 6 wherein said corium is bovine, porcine, or a mixture thereof.

8. The method according to claim 1 wherein said metal powder comprises one or more of aluminum, copper, stainless steel, titanium, iron, chromium, manganese, tin, and zinc.

9. The method according to claim 1 wherein said metal powder comprises at least two different metal species.

10. The method according to claim 9 wherein the ratio of said first metal species to said second metal species in said metal powder is about 1:1 to about 1:9 by weight.

11. The method according to claim 9 wherein said metal powder comprises copper and one or more of aluminum, titanium, and zinc.

12. The method according to claim 1 wherein said metal powder comprises particles having an average major dimension of less than about 10 microns.

13. The method according to claim 1 wherein the ratio of metal powder to collagen nanofibrils in said blend is about 1:1 to about 40:1 by weight.

14. The method according to claim 13 wherein the ratio of metal powder to collagen nanofibrils in said blend is about 1:1, about 5:1, about 10:1, or about 20:1 by weight.

15. The method according to claim 1 wherein said shaped body is formed by applying said blend onto a substrate.

16. The method according to claim 1 wherein said shaped body is formed by freezing said blend.

17. The method according to claim 1 wherein the amount of carrier is reduced in shaped body by freeze-drying.

18. The method according to claim 1 wherein the removal of a major proportion of the collagen nanofibrils comprises flash heating said shaped body, followed by sintering said shaped body.

19. The method according to claim 18 wherein said flash heating is performed at a temperature of about 300° C. to about 1400° C.

20. The method according to claim 19 wherein said flash heating is performed at a temperature of about 400° C., about 600° C., about 800° C., or about 1200° C.

21. The method according to claim 18 wherein the duration of said flash heating is from about 1 to about 3 hours.

22. The method according to claim 18 wherein said sintering is performed at a temperature of about 400° C. to about 1400° C.

23. The method according to claim 22 wherein said sintering is performed at a temperature of about 600° C., about 800° C., about 900° C., about 1000° C., about 1100° C., or about 1200° C.

24. The method according to claim 18 wherein the duration of said sintering is from about 1 to about 6 hours.

25. The method according to claim 1 wherein said heating is effective to produce an average pore size of about 1 to about 100 microns in said porous metallic structure.

* * * * *